United States Patent [19]

Nokes

[11] 4,379,475

[45] * Apr. 12, 1983

[54] WEDGING APPARATUS USEFUL FOR LOG SPLITTING

[76] Inventor: Ronald W. Nokes, 8150 LaPlace Ct., Westminster, Colo. 80030

[ * ] Notice: The portion of the term of this patent subsequent to Mar. 10, 1998, has been disclaimed.

[21] Appl. No.: 241,075

[22] Filed: Mar. 6, 1981

Related U.S. Application Data

[63] Continuation-in-part of Ser. No. 823,490, Aug. 10, 1977, Pat. No. 4,254,808.

[51] Int. Cl.[3] ..... B27L 7/00

[52] U.S. Cl. ..... 144/193 C; 144/193 R; 173/102

[58] Field of Search ..... 144/193 R, 193 C, 193 D; 254/104; 173/102, 91

[56] References Cited

U.S. PATENT DOCUMENTS

| | | | |
|---|---|---|---|
| 2,474,037 | 6/1949 | Cuthrell | 144/193 |
| 2,526,362 | 10/1950 | Johnson | 144/193 |
| 3,050,095 | 8/1962 | Prather | 144/193 |
| 3,313,356 | 4/1967 | Clevenger | 144/193 C |
| 3,865,163 | 2/1975 | Root | 144/193 A |
| 4,254,808 | 3/1981 | Nokes | 144/193 C |
| 4,280,540 | 7/1981 | Meacham | 144/193 C |
| 4,308,903 | 1/1982 | Alloway | 144/193 D |

OTHER PUBLICATIONS

Blair and Ketchum, "Country Journal", 1980, p. 75.

*Primary Examiner*—W. D. Bray
*Attorney, Agent, or Firm*—Young & Martin

[57] ABSTRACT

Two elongated members are coaxially movable relative to one another with one member rigidly attached to a working head such as an elongated wedge or the like. In one embodiment, the inner member is fixed to the working head while the outer member movably surrounds the inner member. The outer member is dimensioned so that its lower perimeter edge is small enough to allow the members to be reciprocated so as to drive the head into a log or other material without the outer member being held against coaxial reciprocal movement by the material. The members can be secured as for lifting, withdrawing, transporting, and the like with a flexible collar on the outer member for cooperating with a hole therethrough for gripping the inner member. The outer member can be fixed to the working head and the inner member reciprocally movable therein. Shock absorbing handles and an impact surface cushion insert are also shown which reduce jarring and fatigue in an operator's hands and arms.

12 Claims, 11 Drawing Figures

WEDGING APPARATUS USEFUL FOR LOG SPLITTING

CROSS-REFERENCE TO RELATED APPLICATION

This application is a continuation-in-part of application Ser. No. 823,490, filed Aug. 10, 1977 now U.S. Pat. No. 4,254,808.

BACKGROUND OF THE INVENTION

The present invention relates to apparatus for splitting or separating yieldable materials. More particularly, the present invention relates to apparatus for performing a wedging function on any material having a softer composition than the material from which the wedging apparatus is fabricated. The present invention is particularly useful for splitting logs, lumber products or the like but has other utilities that will be readily apparent from the description herein. For instance, the invention can be used for driving holes into the earth, splitting rocks, and so forth.

The problem of how to split logs and the like lengthwise has been predominantly resolved by the use of angular shaped wedges which are pounded into the log by mauls, sledgehammers or other instruments. The task can be satisfactorily completed by use of such implements but certain hazards and difficulties are inherently encountered. For example, the top of the wedge frequently releases flakes of metal upon impact, the holding of the wedge in place for initial striking necessarily exposes the user to injury especially to the hands and arms, the head of the maul or hammer may glance from the head of the wedge or unexpectedly separate from the handle exposing the user to serious injury, etc. Furthermore, particularly with large hardwood logs, the wedge will enter the log to a point where it can no longer be struck by the maul but is securely held in that position by the log thereby requiring the use of additional wedges or some other procedure for completing the log splitting. Additionally, the wedges and hammers needed for this form of log splitting somehow seem to frequently be in widely sparated locations when they are needed as anyone who has had any experience with log splitting by this procedure can attest.

One prior art solution to the myriad of problems associated with log splitting as mentioned above is through the use of hydraulic powered wedges. This solution is not attractive to the average log splitter since the device is expensive, inconvenient to transport, requires a suitable frame for holding the logs in place, and involves multiple moving parts that are subject to costly repair. Although lever actuated cutter devices such as that shown in U.S. Pat No. 2,526,362 by Johnston may be adapted for transverse cutting of some logs, these type devices are not suitable for lengthwise log splitting especially in view of the awkwardly large log holding frame that would be needed as well as the excessively long cutter elements and lever lengths for adaption to log splitting. Even if so adapted, the Johnston type apparatus would not be convenient for easy transport by an individual user.

So-called captured hammer devices have been suggested in the prior art such as in U.S. Pat. No. 2,474,037 by Cuthrell and U.S. Pat. No. 3,050,095 by Prather. Cuthrell employs a tractor mounted trip-hammer type mechanism wherein the wedge element is positioned upon a reciprocally moveable carriage so that it can be raised by the tractor's winch and released to fall upon the object to be severed. Prather shows an elongated stem of a hexagonal cross-section with a piercing tip on one end and a large diameter weight slidable on the stem between two stops. Neither device is acceptable to the average log splitter since, in the case of Cuthrell, an unacceptably complex mechanism is required whereas for Prather, the elongated stem must be at least approximately as long or longer than the longest log that may be split. Prather further requires acceptance of exposed anvil surfaces at the stops, a hazard somewhat similarly involved in the Cuthrell device. Further, a typical disadvantage of prior art manually operated captured hammer devices, such as the Prather device, the shock generated by the hammer portion on the impact surface is transmitted through the rigid hammer structure and associated rigid handles to the operator's hands and arms. This constant repetition of such shock applied to the person's hands and arms cause discomfort, soreness and premature fatigue that can be quite painful and debilitating to a person after extended use of such devices.

Another prior art attempt to overcome the difficulties of single wedge use is suggested in U.S. Pat. No. 3,865,163 by Root wherein outwardly pivotable jaws are hinged to the wedge element to spread the log sides as the wedge enters the log. However, various mechanical disadvantages render these devices unacceptable such as the difficulty in selecting a universally usable jaw length and reliability problems with long-term usage because of the stress associated with the jaw pivot points.

SUMMARY OF THE INVENTION

Accordingly, it is an object of the present invention to provide novel shock absorbing handle bars and an impact surface cushion, for a captured hammer type wedge device to dampen shock vibrations caused by the impact of the hammer apparatus transmitted to an operators hands and arms.

The present invention is an apparatus particularly well suited for performing wedging type operations such as log splitting and the like. Typically the invention includes a pair of elongated members arranged so that one such member is coaxially moveable relative to the other through the agency of one member being hollow for receiving the other member. An elongated, preferably wedge shaped working head is rigidly attached to one of the coaxially reciprocable members. That is, the working head has a base and a tapered body extending from the base with one of the elongated members rigidly attached to this base so that the central axis of the attached member is generally normal to the plane of the base. Thus the coaxially moveable members can introduce impact forces directly upon or via transferal to the head as a result of the movement between the members. These impact forces drive the head into the log until it has completely passed through the log.

In one form of the invention, the outer member is moveable with the outer, lower edge thereof configured so as to be equal to or less than the dimension of the wedged opening in the log. A cap enclosing one end of the outer member can be included to provide driving impact to the inner member and, by having the outer member shorter than the inner member, a greater thickness of the outer member can be fixed to the working head base and the inner member reciprocally moveable therein.

An especially advantageous feature of the present invention resides in the shock absorber means for dampening the shock vibrations caused by the impact of the hammer apparatus before they are transmitted to an operator's hands and arms. An exemplary form of this feature includes semi-flexible springy handle bars mounted on and extending radially outwardly from the hammer apparatus terminating in hand grip portions at the respective distal ends and a resilient member insert interposed between the impact surfaces of the hammer apparatus.

DETAILED DESCRIPTION OF THE PREFERRED EMBODIMENT

Figure 1:
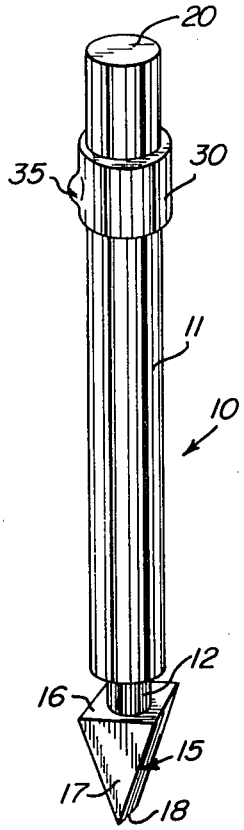
FIG. 1 is a perspective view of one form of preferred embodiment of the present invention.
Figure 2:
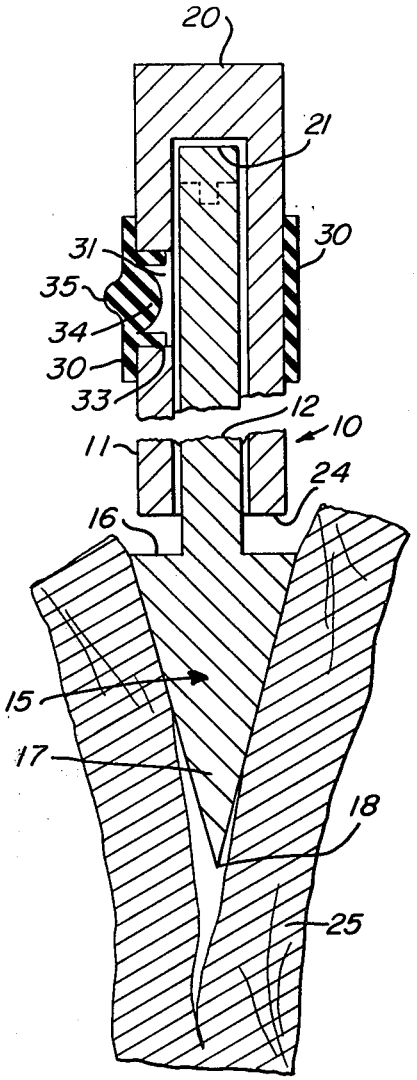
FIG. 2 is a broken and sectioned view of the FIG. 1 embodiment shown as it is entering a log.

An exemplary form of the preferred embodiment of a wedging apparatus particularly useful for log splitting is shown in FIGS. 1 and 2. The splitter assembly 10 includes elongated outer member 11 which has a hollow interior for receiving inner member 12. A wedge shaped working head 15 is shown with a base 16 and an outwardly extending but tapered body 17 which terminates in a cutting edge or point 18. Inner member 12 is rigidly attached to head 15 in normal relation to the general plane of base 16 relative to the central axis of member 12. Although member 12 is shown joined integrally with head 15, it will be understood that it can be attached by threads, welding, bonding or any suitable arrangement. The cross-sectional configuration of members 11 and 12 can be cylindrical as illustrated or of any appropriate cross-section as long as they are coaxially reciprocable.

As is best seen in FIG. 2, elongated member 11 has a hollow interior so as to allow coaxial relative movement between members 11 and 12. Outer member 11 has an end cap 20 either formed integrally therewith or otherwise suitably attached. Member 12 is of a greater axial length than outer member 11 as is evident by the gap between base 16 of head 15 and the lower end face 24 of member 11. Thus end cap 20 impacts end 21 of inner member 12 each time member 11 is raised and dropped or rammed downwardly thereby transferring a wedging force to head 15.

Note that cap 20 can be replaceable as by threaded attachment to member 11 thereby permitting increase or decrease of the total weight of member 11 and cap 20 combined. For convenience, the upper portion of inner member 12 including impact surface 21 can be a removable plug threaded or force-fit into the main body of member 12, as shown in broken lines in FIG. 2. This feature permits replacement of the plug as it deforms or mushrooms from extended use. Further, such a plug can be of a smaller diametric dimension at face 21 than the main body of member 12 to accommodate at least some of this deformation.

As shown in FIG. 2, the outer edge of lower face 24 of outer member 11 is dimensioned so as to be equal to or smaller than the wedged opening of log 25 as it is split. Although the outer edges of face 24 are shown slightly narrower than the width of head base 16 in FIG. 2, the width of face 24 can clearly be somwhat larger than base 16 and still not be frictionally impeded from reciprocation by the interior walls of log 25 as it is split. Of course, the outer, lower portion of member 11 can be itself tapered to clear the split log walls if desired.

As a consequence, continual raising and lowering of member 11 so as to impact member 12 will not be disrupted by the entire head 15 entering the log to be split. The wedge head can be continually driven under influence of the coaxially reciprocating motion between members 11 and 12 until head 15 has completely passed through log 25.

Member 11 and 12 can be arranged so as to include means for temporarily interlocking against the coaxial movement to facilitate withdrawal and transporting of the device as a unit. One advantageous arrangement for accomplishing this result is shown in FIGS. 1 and 2 in the form of flexible band 30, which snugly fits over the outer circumferential surface of member 11. Outer member 11 has a bore 31 into which a ring 33 and inwardly extending bulbous portion 34 are seated when band 30 is in place. The small outwardly extending nub 35 aids the user in locating the proper pressure point when interlocking is desired. The interlocking is established by the user grasping member 11 around band 30 when inner member 12 is positioned with end 21 generally as depicted in FIG. 2. Radially inward pressure on nub 35 causes bulbous portion 34 to deform into bore 31 until it engages the outer surface of member 12. The outside surface of member 12 can be knurled or other suitable procedures taken to increase friction as necessary. At this point, the user can lift the entire device as a unit.

Figure 3:
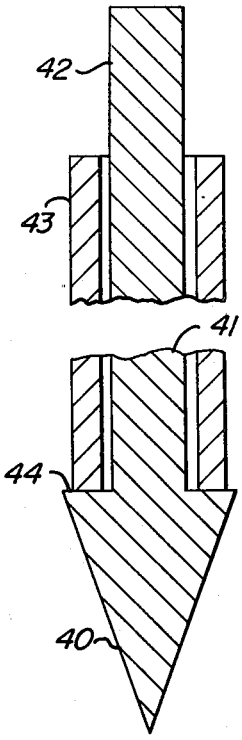
FIG. 3 is a sectioned and broken side view of a variation of the preferred embodiment.
Figure 6:
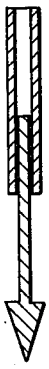
FIG. 6 is a sectioned side view of the FIG. 3 embodiment with the movable member in a typical raised position immediately prior to its downward movement to impact the wedge head.

In FIGS. 3 and 6, wedge or working head 40 is rigidly attached to inner elongated member 41 in a manner somewhat similar to the FIG. 1 arrangement. However, the outer member 43, which is coaxially movable over member 41, has no end cap and therefore is allowed to impact the upper surface 44 of head 40. As will be readily apparent to those having skill in the art from the foregoing description as well as from the perusal of the drawings (i.e., FIGS. 1 and 2 along with FIG. 3), outer member 43 is of a length for accommodating manual reciprocal movement of the upper end thereof substantially beyond the upper end of inner member 41 while maintaining the coaxial relation between members 41 and 43. Additionally, inner member 41 is made of a longer dimension lengthwise than member 43 so that a portion 42 extends above as shown for grasping and transporting of the entire unit without the need for an interlocking device.

Figure 4:
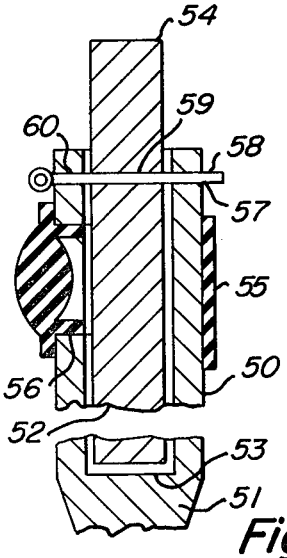
FIG. 4 is a side view in broken section showing additional variations of the preferred embodiment.

FIG. 4 shows an embodiment wherein the outer member 50 is rigidly attached to working head 51. Inner coaxially movable member 52 impacts the upper inner surface 53 of head 51 and is retractable via upper extension 54. The FIG. 4 embodiment shows a temporary interlocking flexible band 55 deformable into hole 56 in a manner somewhat analogous to the structure described hereinbefore in FIG. 1. Additionally, a pin 58 can be inserted through bores 57, 59 and 60 through members 50 and 52. This pin 58 thereby more permanently interlocks the movable elements for convenient transport.

Figure 5:
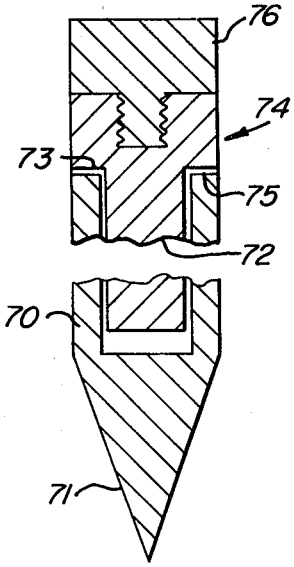
FIG. 5 is a broken and sectioned side view illustrating replaceable end caps and other variations of the preferred embodiment.

FIG. 5 shows an embodiment somewhat similar to FIG. 4 except that outer member 70, which is rigidly attached to work head 71, is longer in length than inner member 72. Thus the driving force for head 71 is developed by the lower flange surface 73 of cap end 74 impacting the upper surface 75 of member 70. FIG. 5 also illustrates a means for varying the weight of the impacting member 72 through replaceable stub 76 shown here as threadedly engaged into member 72.

Figure 7:
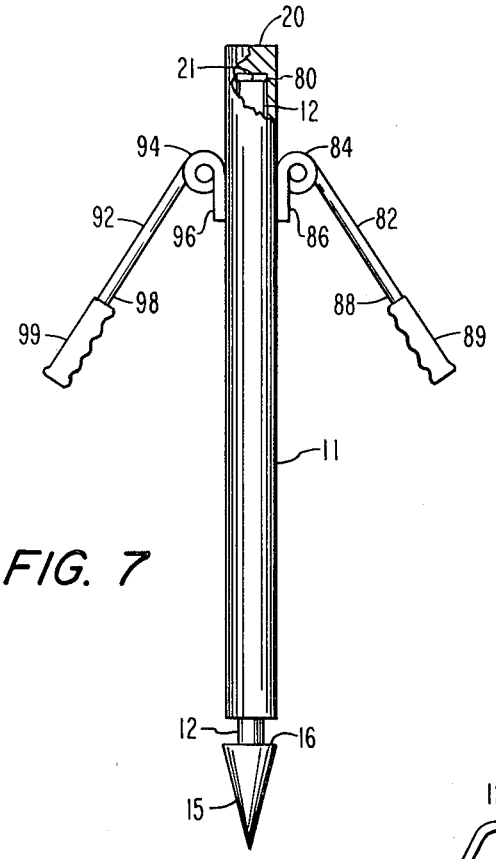
FIG. 7 is an elevation view of the embodiment shown in FIG. 1, including the shock absorber features of the present invention.

A particularly advantageous feature of the present invention is the shock absorber apparatus, as shown in FIGS. 7 through 11. In FIG. 7, a log splitter similar to that shown in FIG. 1 includes an outer elongated member 11 in the form of an elongated cylinder having an internal bore therein extending upwardly from the lower end to an upper capped end 20. An inner elongated member 12 is received in the bore of the outer elongated member 11, and the outer member 11 is slidable up and down over the inner member 12 in the manner of a conventional captured hammer arrangement. As the outer elongated member 11 is slid downwardly over the inner elongated member 12, the capped end 20 will strike the upper end of inner member 12, with the inside surface of capped end 20 and the upper surface 21 of inner member 12 being the impact surfaces of the respective elongated outer and inner members 11, 12. In this embodiment, a cushion insert 80, preferably of a material such as neoprene rubber or resilient plastic, is positioned between the respective impact surfaces of the inside surface of capped end 20 and the upper end 21 of inner member 12.

The embodiment shown in FIG. 7 is also provided with a pair of shock absorbing handles 82, 92. Each handle 82, 92 is made of elongated semi-flexible material, a portion of which is coiled in a helicoid 84, 94. The upper ends 86, 96 are affixed to the exterior walls of elongated member 11 in such a manner that the handle bars 82, 92 extend radially outwardly and downwardly from opposite sides of the elongated member 11. Hand grip cushions 89, 99 are provided in the lower ends 88, 98 of handle bars 82, 92, respectively.

The shock generated by the impact surfaces striking one another in conventional apparatus would normally be transferred to the person's hands and arms by the solid components of the outer member 11. However, the combination of the semi-flexible handle bars 82, 92 and the resilient insert 80 between the impact surfaces in the present invention dampen significantly the shock transferred to a person's hands and arms. The insert 80 is preferably somewhat resilient but not so resilient or so thick as to significantly inhibit the momentum transfer from the outer elongated member 11 to the inner elongated member 12. Further, the handle bars 82, 92 are semi-flexible and resilient such that they are effective for driving the outer elongated member 11 downwardly with a significant force, while still effectively dampening or absorbing a significant amount of the shock generated by the respective impact surfaces hitting on one another.

Figure 8:
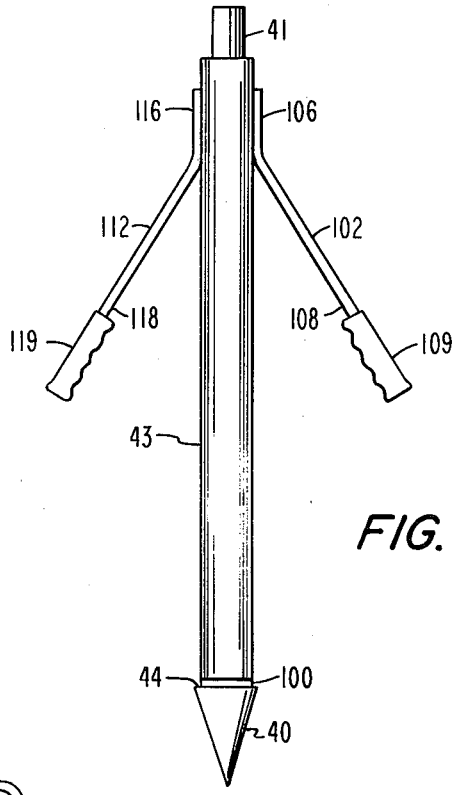
FIG. 8 is an elevation view of the embodiment shown in FIG. 3, including a variation of the shock absorber apparatus of the present invention.

In FIG. 8, the embodiment of FIG. 3 is shown with a pair of semi-flexible handle bars 102, 112, attached at their upper ends 106, 116, respectively, to extend radially outwardly and downwardly from opposite sides of the outer member 43. An annular resilient shock absorbing insert 100 is positioned between the impact surfaces defined by the lower end of outer member 43 and the upper surface 44 of tapered wedge or working head 40.

Figure 9:
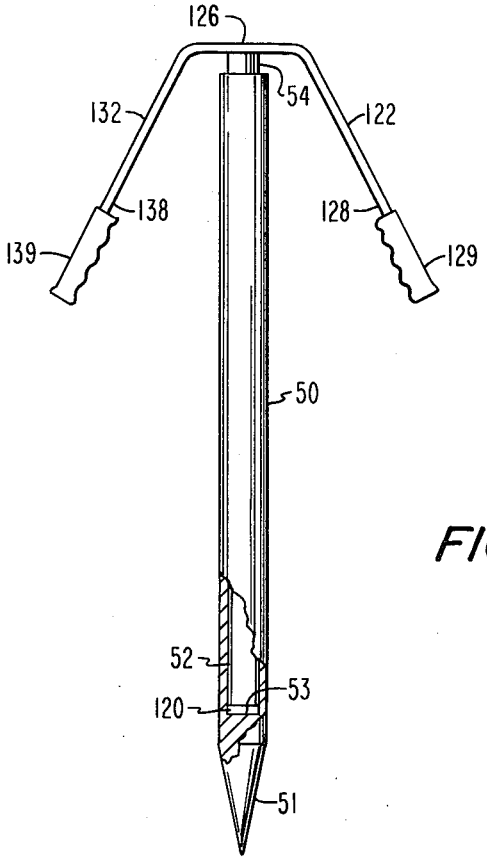
FIG. 9 is an elevation view of the embodiment shown in FIG. 4, including another variation of the shock absorber apparatus of the present invention.

In FIG. 9, an embodiment similar to that shown in FIG. 4 is equipped with a pair of handle bars 122, 132 attached to and extending outwardly and downwardly from the upper end 54 of inner elongated member 52. The upper portions of handle bars 122, 132 form a common cross-member 126, and hand grip pieces 129, 139 are provided on the distal ends 128, 138 of the handle bars 122, 132.

Figure 10:
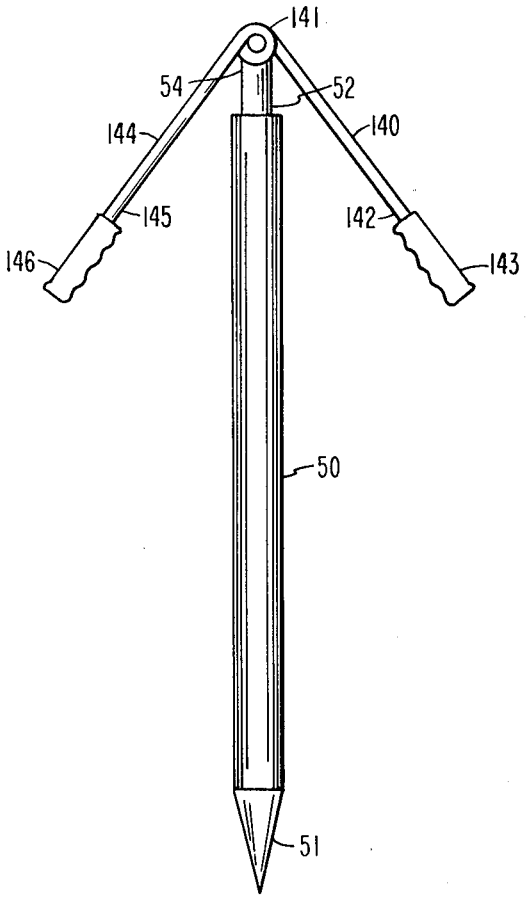
FIG. 10 is another elevation view of the embodiment shown in FIG. 4, including still another variation of the shock absorber handle bars of the present invention.

FIG. 10 is also essentially the same embodiment as FIG. 4, with the addition of handle bars 140, 144 attached to the upper end 54 of inner elongated member 52. The hand bars 140, 144 extend outwardly and downwardly from opposite sides of a common helicoid 141 formed by said handle bars and affixed to the upper end 54 of inner elongated member 52.

Figure 11:
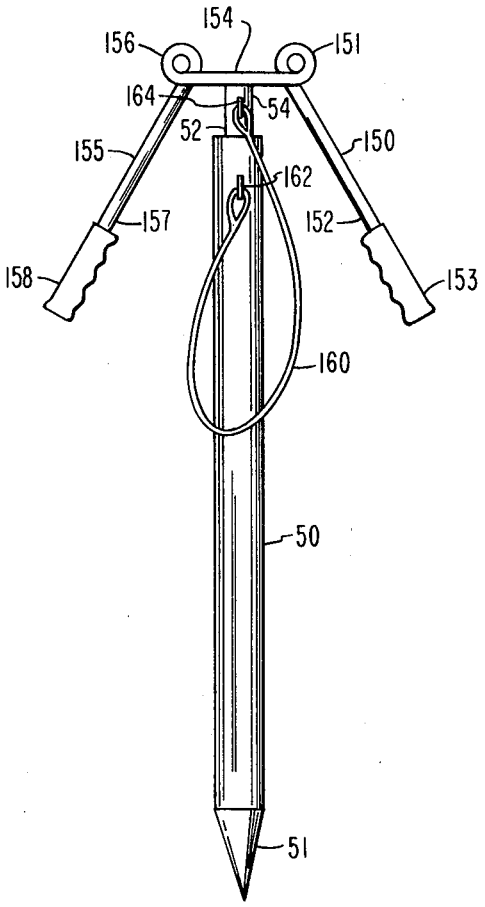
FIG. 11 is an elevation view of the embodiment shown in FIG. 4, including still another variation of the shock absorbing handle bars, and including a flexible cord for holding the parts of the apparatus together.

FIG. 11 is another variation of the embodiment shown in FIG. 4, with shock absorbing handles 150, 155 extending radially outwardly and downwardly from opposite sides of the top end 54 of inner member 52. A common cross-member 154 is affixed to the top 54 of inner elongated member 52, with each of the outer ends of cross-member 154 being formed in respective helicoids 151, 156 at opposite sides of the inner member 52. The handles 150, 155 respectively extend downwardly from the respective helicoids 151, 156. Hand grips 153, 158 are positioned on the lower distal ends 152, 157, respectively of the handle bars 150, 155. As described above for the other shock absorber handle bars, these handle bars 150, 155 are preferably fabricated of a semi-flexible, resilient spring-steel material that is capable of transferring downward forces to the inner member 52, but which also are effective in dampening the shock created by the respective impact surfaces of the outer and inner members 50, 52.

In the embodiment shown in FIG. 11, a flexible cord 160 is shown attached at one end to a loop affixed to outer member 50 and at the other end to a loop affixed to the upper end 54 of inner member 52. This flexible cord is dimensioned to retain the inner member 52 slidably within the outer member 50. This feature also is quite effective for binding the inner and outer members together during storage or transportation by simply wrapping the flexible cord around the handle bars 150, 155, or over cross-member 154 when the apparatus is not in use.

Although the present invention has been described with a certain degree of particularity, it is understood that the present disclosure has been made by way of example and that various changes, variations, modifications and applications of the present invention will be readily apparent to those having normal skill in the art without departing from the spirit of the present invention.

What is claimed is:

1. In apparatus for performing wedging type operations on a severable material as in log splitting and the like, including first and second elongated members positioned in concentric, coaxially slidable relation to each other, the first of said elongated members having a base and a tapered wedge body extending from said base to a tip and an impact surface adapted to receive impact force components directed parallel to the longitudinal axis of said tapered wedge body, and the second of said elongated members being adapted to be driven manually by a person in coaxial, longitudinal relation to the first elongated member and having an impact surface in axial alignment with the impact surface on said first elongated member and from the inertial momentum of said second elongated member to said impact surface on said first elongated member when said second elongated member is moved coaxially in relation to said first elongated member, the improvement comprising:

shock absorber means mounted on said apparatus for dampening shock transmitted by said second elongated member from the impact surface thereon to the person's hands.

2. The improvement of claim 1, wherein said shock absorber means includes semi-flexible handle means affixed to and extending outwardly from said second elongated member adapted for effectively transmitting driving force components exerted manually by the person to said impact surfaces parallel to the longitudinal axis of said tapered wedge body, said handles being sufficiently rigid to apply said driving force components on said second elongated body member, yet sufficiently flexible to effectively dampen the shock generated by said impact surfaces upon impact and to dull the effect of the shock on the persons hands and arms.

3. The improvement of claim 2, wherein said handle means includes a right handle bar and a left handle bar, each of which handlebars is a semi-flexible, springy bar affixed to and extending radially outwardly from respectively opposite sides of said second elongated member.

4. The improvement of claim 3, wherein a position of each of said handle bars in proximity to said second elongated member is a helicoid.

5. The improvement of claim 1 or 2, wherein said shock absorber means includes a resilient member interposed between said impact surfaces of said first and second elongated members.

6. Manually operated apparatus for performing wedging type operations on a severable material as in log splitting and the like, comprising:

first and second elongated members positioned in concentric, coaxially slidable relation to each other, the first of said elongated members having a base and a tapered wedge body extending from said base to a tip and a first impact surface adapted to receive impact force components directed parallel to the longitudinal axis of said tapered wedge body, and the second of said elongated members being adapted to be driven manually by a person in coaxial, longitudinal relation to the first elongated member and having a second impact surface in axial alignment with the first impact surface on the first elongated member and adapted to impact on and to transfer forces from the inertial momentum of said second elongated member to the said first impact surface on said first elongated member when said second elongated member is moved coaxially in relation to said first elongated member, a pair of semi-flexible, springy handle bars, each of which is affixed to and extends radially outwardly from respectively opposite sides of said second elongated member and is adapted to effectively transmit driving force components parallel to the longitudinal axis of said tapered body exerted on the distal end thereof by a person's hand to move said second impact member on said second elongated member toward and into contact with said first impact surface on said first elongated member while also being adapted to dampen the shock created by said first and second impact surfaces striking each other and transmitted by said second elongated body member to the persons hand.

7. The apparatus of claim 6, wherein said second elongated member is cylindrical in shape with a bore therethrough adapted to slidably receive said first elongated member therein, said first impact surface being on the end of said first elongated member opposite said base, and said second elongated member being shorter than said first elongated member and having a capped end with said second impact surface being on the inside surface of said capped end, and wherein each of said handle bars is attached to respectively opposite sides of said second elongated member in proximity to said capped end and extends radially outwardly and downwardly therefrom and terminates in a hand grip portion at its distal end.

8. The apparatus of claims 6, wherein said second elongated member is cylindrical in shape with a bore therethrough adapted to slidably receive said first elongated member therein, said first impact surface being on the annular upper surface of said base around the end of said first elongated member adjacent said base, and said second impact surface being on the end of said second elongated member nearest said base, and wherein each of said handle bars is attached to respectively opposite sides of said second elongated member a spaced distance upwardly from said second impact surface and extends radially outwardly and downwardly from that attachment location and terminates in a hand grip portion at its distal end.

9. The apparatus of claim 6, wherein said first elongated member is cylindrical in shape with a bore therethrough to a closed end at said base adapted to slidably receive said second elongated member therein, said first impact surface being said closed end at said base, and said second elongated member being longer than said first elongated member with said second impact surface being on the end of said second elongated member nearest said base, and wherein each of said handle bars is attached to and extends radially outwardly in opposite directions and downwardly from the end of said second elongated member opposite said second impact surface and terminates in a hand grip portion at its distal end.

10. The apparatus of claim 7, 8, or 9, wherein a portion of each of said handle bars adjacent the side of said second elongated member is a helicoid.

11. The apparatus of claim 7, 8, or 9, including a resilient shock absorbing member interposed between said first and second impact surfaces.

12. The apparatus of claim 7, 8, or 9, including a flexible elongated cord attached at one end to said first elongated member and attached at the other end to said second elongated member, the length of said cord being sized such that it is fully extended when said first and second elongated members are inseparable with a portion of one of said first and second elongated members still positioned in a portion of the bore of the other while being long enough to allow sufficient longitudinally sliding movement of one of said first and second elongated members for a person to developed sufficient momentum in said second elongated member to effectively perform wedging type operations with the apparatus.

* * * * *